US007297047B2

(12) United States Patent
Lee et al.

(10) Patent No.: US 7,297,047 B2
(45) Date of Patent: Nov. 20, 2007

(54) BUBBLE SUPPRESSING FLOW CONTROLLER WITH ULTRASONIC FLOW METER

(75) Inventors: Songjae Lee, San Jose, CA (US); Ho Seon Shin, Cupertino, CA (US); Donald J. K. Olgado, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 54 days.

(21) Appl. No.: 11/292,839

(22) Filed: Dec. 1, 2005

(65) Prior Publication Data

US 2007/0128982 A1 Jun. 7, 2007

(51) Int. Cl.
*B24B 49/00* (2006.01)

(52) U.S. Cl. ..... 451/5; 45/11; 45/287; 45/446

(58) Field of Classification Search ..... 451/5, 451/11, 36, 287, 446
See application file for complete search history.

(56) References Cited

U.S. PATENT DOCUMENTS

| | | | | |
|---|---|---|---|---|
| 4,391,149 | A * | 7/1983 | Herzl | 73/861.25 |
| 4,438,652 | A * | 3/1984 | Saito | 73/861.25 |
| 5,433,650 | A | 7/1995 | Winebarger | |
| 5,453,312 | A | 9/1995 | Haas et al. | |
| 5,679,063 | A | 10/1997 | Kimura et al. | |
| 5,692,950 | A | 12/1997 | Rutherford et al. | |
| 5,738,574 | A | 4/1998 | Tolles et al. | |
| 5,816,900 | A | 10/1998 | Nagahara et al. | |
| 6,139,406 | A | 10/2000 | Kennedy et al. | |
| 6,183,354 | B1 | 2/2001 | Zuniga et al. | |
| 6,244,935 | B1 | 6/2001 | Birang et al. | |
| 6,315,635 | B1 | 11/2001 | Lin | |
| 6,398,627 | B1 | 6/2002 | Chiou et al. | |
| 6,418,960 | B1 | 7/2002 | Mintz et al. | |
| 6,429,131 | B2 | 8/2002 | Lin et al. | |
| 6,435,942 | B1 | 8/2002 | Jin et al. | |
| 6,435,945 | B1 | 8/2002 | Somekh | |
| 6,516,675 | B1 * | 2/2003 | Jan et al. | 73/861.63 |
| 6,517,414 | B1 | 2/2003 | Tobin et al. | |
| 6,629,881 | B1 | 10/2003 | Redeker et al. | |
| 6,676,383 | B2 * | 1/2004 | Schob | 417/53 |
| 2002/0048214 | A1 * | 4/2002 | Lin et al. | 366/154.2 |
| 2002/0068516 | A1 | 6/2002 | Chen et al. | |
| 2003/0027505 | A1 | 2/2003 | Withers et al. | |
| 2003/0176151 | A1 | 9/2003 | Tam et al. | |
| 2003/0199229 | A1 | 10/2003 | Vereen et al. | |
| 2004/0072503 | A1 * | 4/2004 | Chang et al. | 451/41 |
| 2004/0101415 | A1 * | 5/2004 | Schoeb | 417/53 |
| 2004/0142640 | A1 | 7/2004 | Prabhu et al. | |
| 2006/0025049 | A1 | 2/2006 | Sun et al. | |

* cited by examiner

*Primary Examiner*—Eileen P. Morgan
(74) *Attorney, Agent, or Firm*—Patterson & Sheridan

(57) ABSTRACT

A method and apparatus for the delivery of slurry solution comprising an ultrasonic flow meter positioned between a fluid preparation manifold and a slurry delivery arm, and a shutoff valve positioned between a proportional valve and the slurry delivery arm. Also, a method and apparatus for the delivery of slurry solution including an ultrasonic flow meter positioned to receive fluid from a fluid preparation manifold, a proportional valve and stepper motor in communication with the flow meter, and a reverse flow restrictor in communication with the proportional valve and a slurry delivery arm.

20 Claims, 3 Drawing Sheets

BUBBLE SUPPRESSING FLOW CONTROLLER WITH ULTRASONIC FLOW METER

BACKGROUND OF THE INVENTION

1. Field of the Invention

Embodiments of the present invention generally relate to a slurry delivery method and apparatus for polishing a substrate in a chemical mechanical polishing system.

2. Description of the Related Art

Chemical mechanical planarization, or chemical mechanical polishing (CMP), is a common technique used to planarize substrates. In conventional CMP techniques, a substrate carrier or polishing head is mounted on a carrier assembly and positioned in contact with a polishing article in a CMP apparatus. The carrier assembly provides a controllable pressure to the substrate urging the substrate against the polishing article. The article is moved relative to the substrate by an external driving force. Thus, the CMP apparatus effects polishing or rubbing movement between the surface of the substrate and the polishing article while dispersing a polishing composition to effect both chemical activity and mechanical activity.

Chemical mechanical planarization systems generally utilize a polishing head to retain and press a substrate against a polishing surface of a polishing material while providing motion therebetween. Some planarization systems utilize a polishing head that is moveable over a stationary platen that supports the polishing material. Other systems utilize different configurations including a rotating platen to provide relative motion between the polishing material and the substrate. A polishing fluid is typically disposed between the substrate and the polishing material during polishing to provide chemical activity that assists in the removal of material from the substrate. Some polishing fluids may also contain abrasives.

One of the challenges in developing robust polishing systems and processes is providing uniform material removal across the polished surface of the substrate. For example, as the substrate travels across the polishing surface, the edge of the substrate is often polished at a higher rate. This is due in part to the tendency of the substrate to nose drive, that is, centrifugal and frictional forces force the substrate to move toward to exterior of the support surface as the substrate moves across the support surface.

An additional problem with polishing uniformity is the distribution of slurry on the polishing surface. If the slurry is unevenly distributed, the polishing surface may not evenly polish across the substrate surface. If too little slurry is used, the polishing surface may distort the features of the substrate surface. If too much slurry is applied, valuable slurry may be wasted. Therefore, a system for delivering a polishing fluid to a chemical mechanical polishing surface that adjustably distributes and conserves slurry is needed. As the slurry leaves the slurry distribution system, the pressure drop across the system may facilitate the production of gas bubbles in the line. To provide delivery that is uniform and not distorted by the production of gas bubbles is an important process development goal.

SUMMARY OF THE INVENTION

The present invention generally provides more uniform delivery of slurry to a chemical mechanical polishing system. More specifically, the present invention generally provides a method and apparatus for the delivery of slurry solution comprising an ultrasonic flow meter positioned between a fluid preparation manifold and a slurry delivery arm, and a shutoff valve positioned between a proportional valve and the slurry delivery arm. Also, the present invention generally provides a method and apparatus for the delivery of slurry solution including an ultrasonic flow meter positioned to receive fluid from a fluid preparation manifold, a proportional valve and stepper motor in communication with the flow meter, and a reverse flow restrictor in communication with the proportional valve and a slurry delivery arm.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides a slurry delivery method and apparatus for polishing a substrate in a chemical mechanical polishing system. In one aspect, the invention provides a slurry delivery method that utilizes a flow meter, proportional valve, and shut off valve to minimize flow meter error and suppress bubble formation.

Examples of polishing systems which may be adapted to benefit from aspects of the invention are disclosed in U.S. Pat. 6,244,935 issued Jun. 12, 2001 by Birang, et al. and U.S. Pat. No. 5,738,574 issued Apr. 14,1998 to Tolles, et al., both of which are incorporated by reference in their entirety. The REFLEXION®, REFLEXION LK®, and MIRRATM® systems available from Applied Materials, Inc. of Santa Clara, CA may also benefit from aspects of this invention. Although the polishing fluid delivery system 102 is described in reference to the illustrative polishing system 100, the invention has utility in other polishing systems that process substrates in the presence of a polishing film.

Figure 1:
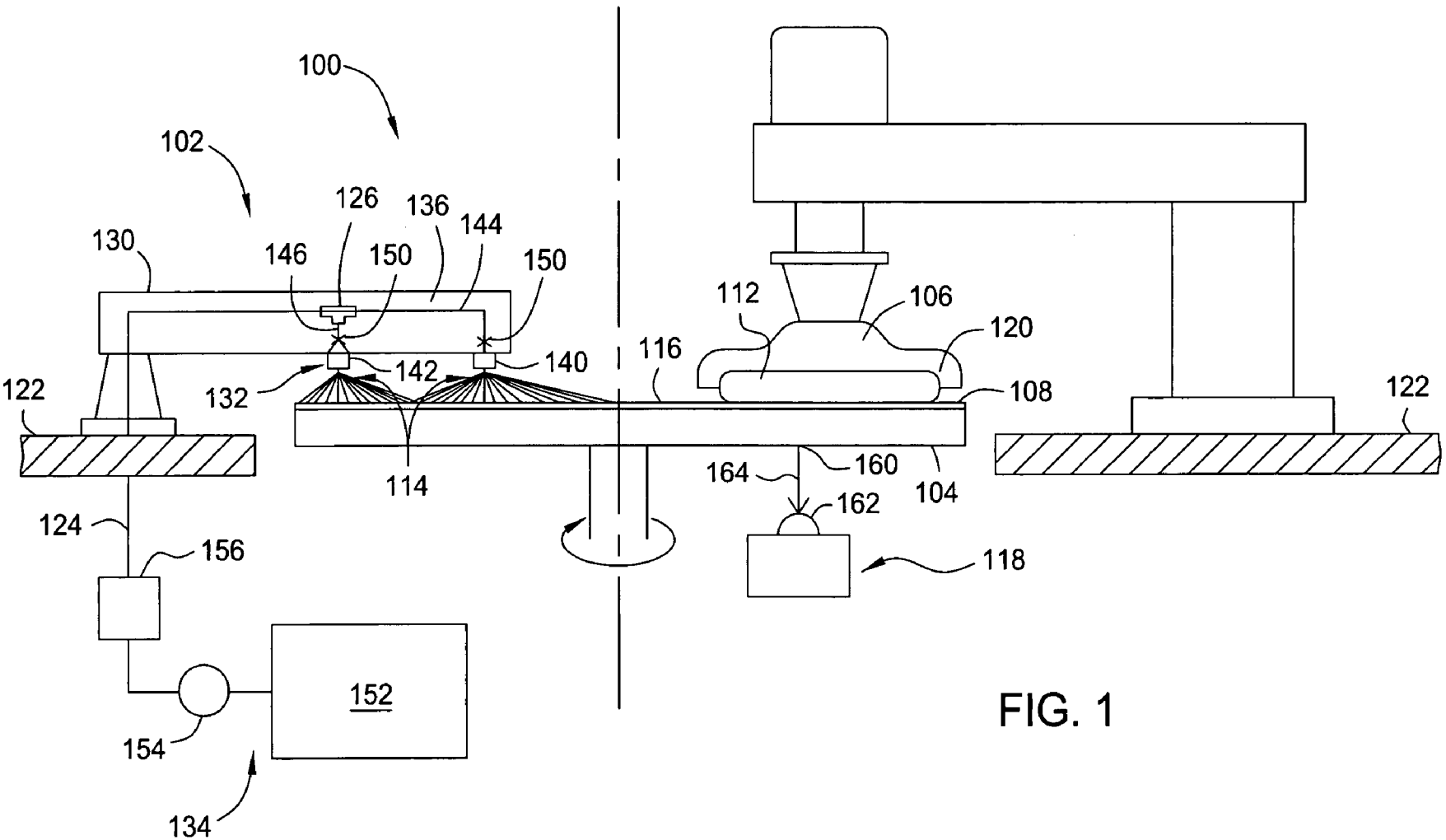
FIG. 1 is a sectional view of a polishing system having one embodiment of a polishing fluid delivery system.

FIG. 1 depicts one embodiment of a polishing system 100 for polishing a substrate 112 having a polishing fluid delivery system 102 that controls the distribution of polishing fluid 114 across a polishing material 108. The exemplary polishing system 100 includes a platen 104 and a polishing head 106. The platen 104 is generally positioned below the polishing head 106 that holds the substrate 112 during polishing. The platen 104 is generally disposed on a base 122 of the system 100 and coupled to a motor (not shown). The motor rotates the platen 104 to provide at least a portion of a relative polishing motion between the polishing material 108 disposed on the platen 104 and the substrate 112. Relative motion between the substrate 112 and the polishing material 108 may be provided by alternative mechanisms. For example, at least a portion of the relative motion between the substrate 112 and polishing material 108 may be provided by moving the polishing head 106 over a stationary platen 104, moving the polishing material linearly under the substrate 112, or moving both the polishing material 108 and the polishing head 106.

The polishing material 108 is supported by the platen 104 so that a polishing surface 116 faces upward towards the polishing head 106. The polishing material 108 is fixed to the platen 104 by adhesives, vacuums, mechanical clamping, or other means during processing. Optionally, and particularly in applications where the polishing material 108 is configured as a web, belt, or linear polishing material, the polishing material 108 is fixed to the platen 104 and is releasable, typically by employing a vacuum disposed between the polishing material 108 and platen 104 as described in the previously incorporated U.S. Pat. No. 6,244,935.

The polishing material 108 may be a conventional or a fixed abrasive material. Conventional polishing material 108 is generally comprised of a foamed polymer and disposed on the platen 104 as a pad. In one embodiment, the conventional polishing material 108 is foamed polyurethane. Such conventional polishing material 108 is available from Rodel Corporation, located in Newark, Del.

Fixed abrasive polishing material 108 is generally comprised of a plurality of abrasive particles suspended in a resin binder that is disposed in discrete elements on a backing sheet. Fixed abrasive polishing material 108 may be utilized in either pad or web form. As the abrasive particles are contained in the polishing material, systems utilizing fixed abrasive polishing materials generally utilize polishing fluids that do not contain abrasives. Examples of fixed abrasive polishing material are disclosed in U.S. Pat. No. 5,692,950, issued Dec. 2, 1997 to Rutherford, et al., and U.S. Pat. No. 5,453,312, issued Sep. 26, 1995 to Haas, et al., both of which are hereby incorporated by reference in their entireties. Such fixed abrasive material 108 is additionally available from Minnesota Manufacturing and Mining Company (3M), located in Saint Paul, Minn.

The polishing head 106 generally is supported above the platen 104. The polishing head 106 retains the substrate 112 in a recess 120 that faces the polishing surface 116. The polishing head 106 typically moves toward the platen 104 and presses the substrate 112 against the polishing material 108 during processing. The polishing head 106 may be stationary or rotate, isolate, or move orbitally, linearly, or a combination of motions while pressing the substrate 112 against the polishing material 108. One example of a polishing head 106 that may be adapted to benefit from the invention is described in U.S. Pat. No. 6,183,354 B1, issued Feb. 6, 2001 to Zuniga, et al., and is hereby incorporated by reference in its entirety. Another example of a polishing head 106 that may be adapted to benefit from the invention is a TITAN HEAD™ wafer carrier, available from Applied Materials, Inc., of Santa Clara, Calif.

The polishing fluid delivery system 102 generally comprises a delivery arm 130, a plurality of nozzles 132 disposed on the arm 130 and at least one polishing fluid source 134. The delivery arm 130 is configured to meter polishing fluid 114 at different flow rates along the arm 130 to control the distribution of polishing fluid 114 on the polishing surface 116 of the polishing material 108. As the polishing fluid 114 is generally supplied from a single source, the polishing fluid 114 is disposed on the polishing material 108 in a uniform concentration but in varying volume across the surface of the polishing material 108.

The delivery arm 130 is generally coupled to the base 122 proximate to the platen 104. The delivery arm 130 generally has at least a portion 136 that is suspended over the polishing material 108. The delivery arm 130 may be coupled to other portions of the system 100 as long as the portion 136 is may be positioned to deliver polishing fluid 114 to the polishing surface 116.

The plurality of nozzles 132 is disposed along the portion 136 of the delivery arm 130 which is disposed above the platen 104. In one embodiment, the nozzles 132 comprise at least a first nozzle 140 and a second nozzle 142. Typically, the first nozzle 140 is positioned on the arm 130 radially inward of the second nozzle 142 relative to the center of rotation of the polishing material 108. The distribution of polishing fluid 114 across the polishing material 108 is controlled by flowing polishing fluid 114 from the first nozzle 140 at a rate different than the flow from the second nozzle 142.

Nozzles 132 are configured to provide a controlled amount of fluid at an adjustable delivery angle and a controlled droplet size to the surface of the polishing material 108. The nozzles 132 have apertures that may be adjusted to provide flow at a specific angle, for example between 0 and 90° normal to the substrate. The apertures may also be adjusted to provide a specific droplet size, for example 15 Å. The improved control over the droplet size and angle of fluid delivery provides a more tailored slurry application to the polishing material 108. This improved control facilitates a more uniform thickness, thinner film across the surface of the polishing material 108. Because the film of polishing fluid is thinner and more controlled, less fluid than that required by conventional processes is needed to compensate for fluid losses due to centrifugal forces across the surface of the polishing material.

The flow rates exiting the first and second nozzles 140, 142 may vary from each other. The flow rates may be fixed relative to each other or be independently adjustable. In one embodiment, the fluid delivery arm 130 includes a polishing fluid supply line 124 that has a tee connection between the first and second nozzles 140, 142. A tee fitting 126 is coupled to the supply line 124 and has a first delivery line 144 coupled to first nozzle 140 and a second delivery line 146 branching therefrom that is coupled to the second nozzle 142.

At least one of the nozzles 132 is controlled by a flow control mechanism 150. The flow control mechanism 150 may be a device which provides a fixed ratio of flow between the nozzles 140, 142 or the flow control mechanism 150 may be adjustable to provide dynamic control of the flow rates. Examples of flow control mechanisms 150 include fixed orifices, pinch valves, proportional valves, restrictors, needle valves, restrictors, metering pumps, mass flow controllers and the like. Alternatively, the flow control mechanism 150 may be provided by a difference in the relative pressure drop between the fluid delivery lines 144, 146 coupling each nozzle 140, 142 and the tee fitting 126.

The polishing fluid source 134 is typically disposed externally to the system 100. In one embodiment, the polishing fluid source 134 generally includes a reservoir 152 and a pump 154. A flow control module 156 is located between the pump 154 and the base 122. The pump 154 generally pumps the polishing fluid 114 from the reservoir 152 through the flow control module 156 and the supply line 124 to the nozzles 132.

The polishing fluid 114 contained in the reservoir 152 is typically deionized water having chemical additives that provide chemical activity that assists in the removal of material from the surface of the substrate 112 being polished. As the polishing fluid 114 is supplied to the nozzles 132 from a single source such as the reservoir 152, the fluid 114 flowing from the nozzles 132 is substantially homogeneous, not varied in concentration of chemical reagents or entrained abrasives. Optionally, the polishing fluid may include abrasives to assist in the mechanical removal of material from the surface of the substrate. The polishing fluids are generally available from a number of commercial sources such as Cabot Corporation of Aurora, Ill., Rodel Inc., of Newark, Del., Hitachi Chemical Company, of Japan, and Dupont Corporation of Wilmington.

In operation, the substrate 112 is positioned in polishing head 106 and brought in contact with the polishing material 108 supported by the rotating platen 104. The polishing head 106 may hold the substrate stationary or may rotate or otherwise move the substrate to augment the relative motion between the polishing material 108 and substrate 112. The polishing fluid delivery system 102 flows the polishing fluid 114 through the supply line 124 to the first and second polishing nozzles 140, 142.

Referring to FIG. 1, configurations having dynamic, adjustable control mechanisms 150 such as proportional valves, needle valves, mass flow controllers, metering pumps, peristaltic pumps and the like, the distribution of polishing fluid 114 on the polishing material 108 may be tailored during the process. For example, the rate of polishing fluid from the first nozzle 140 may be applied to the polishing material 108 at a first rate during one portion of the process and adjusted to a second rate during another portion of the process. The rate of polishing fluid 114 delivery from the second nozzle 142 may also be varied during the polishing process. The adjustments of polishing fluid flows from nozzles 140, 142 are infinite. The use of additional nozzles disposed between the first nozzle 140 and the second nozzle 142 allows the uniformity profile to be further modified and locally shaped by providing more or less polishing fluid 114 at a nozzle disposed between the first nozzle 140 and the second nozzle 142.

Optionally, a polishing fluid delivery system having dynamic control over the flow rates from the nozzles 140, 142 may include a metrology device 118 to provide process feed-back for real-time adjustment of the polishing fluid distribution. Typically, the metrology device 118 detects a polishing metric such as time of polish, thickness of the surface film being polished on the substrate, surface topography, or other substrate attribute.

In one embodiment, the polishing material 108 may include a window 160 that allows the metrology device 118 to view the surface of the substrate 112 disposed against the polishing material 108. The metrology device 118 generally includes a sensor 162 that emits a beam 164 that passes through the window 160 to the substrate 112. A first portion of the beam 164 is reflected by the surface of the substrate 112 while a second portion of the beam 164 is reflected by a layer of material underlying the polished surface of the substrate 112. The reflected beams are received by the sensor 162 and a difference in wavelength between the two portions of reflected beams are resolved to determine the thickness of the material on the surface of the substrate 112. Generally, the thickness information is provided to a controller (not show) that adjusts the polishing fluid distribution on the polishing material 108 to produce a desired polishing result on the substrate's surface. One monitoring system that may be used to advantage is described in U.S. patent application Ser. No. 5,893,796, issued Apr. 13, 1999 by Birang, et al., and is hereby incorporated herein by reference in its entirety.

Optionally, the metrology device 118 may include additional sensors to monitor polishing parameters across the width of the substrate 112. The additional sensors allow for the distribution of polishing fluid 114 to be adjusted across the width of the substrate 112 so that more or less material is removed in one portion relative to another portion of the substrate 112. Additionally, the process of adjusting the flow rates from the nozzles 140, 142 may occur iteratively over the course of a polishing sequence to dynamically control the rate of material removal across the substrate 112 at any time. For example, the center of the substrate 112 may be polished faster by providing more polishing fluid to the center of the substrate 112 at the beginning of a polishing sequence while the perimeter of the substrate 112 may be polished faster at the end of the polishing sequence by providing more polishing fluid to the perimeter area.

Figure 2:
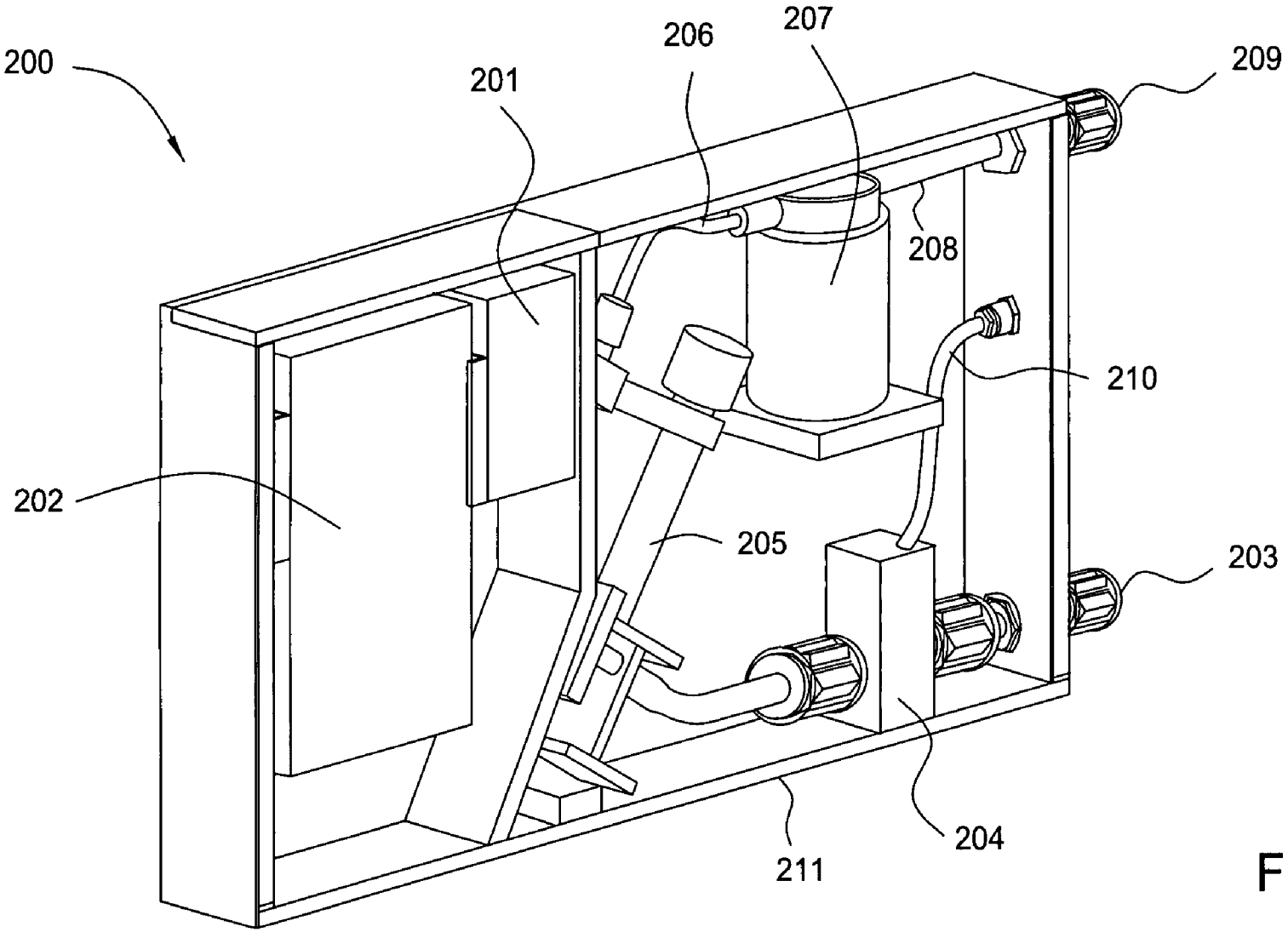
FIG. 2 is a sectional schematic view of a polishing fluid delivery system.

FIG. 2 is a sectional schematic view of a polishing fluid delivery system 200. The system 200 is encased in a drawer 211. The flow of fluid through the system 200 is administered by two pieces of equipment, a CLC controller 201 and a flow meter converter 202. Fluid from a fluid preparation manifold (not shown) enters the system 200 through an inlet 203. The fluid then flows through the shutoff valve 204 in communication with the inlet 203 and an ultrasonic flow meter 205. The shutoff valve 204 is drained by tubing 210. The flow meter 205 releases fluid to flow through tubing 206 and a proportional valve and stepper motor 207. Fluid flows from the proportional valve and stepper motor 207 through the tubing 208 to leave the system 200 through outlet 209.

Figure 3:
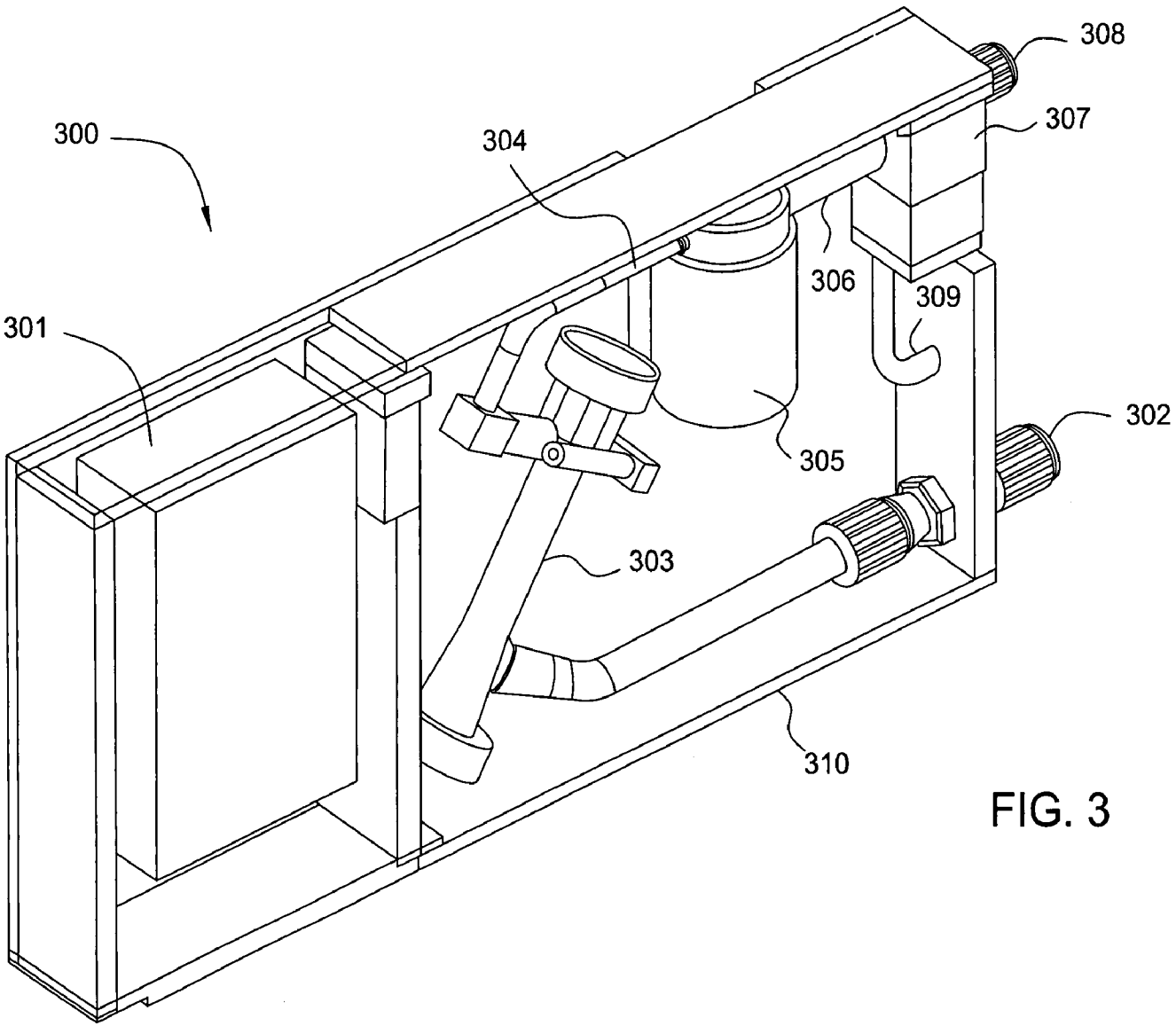
FIG. 3 is a sectional schematic view of an alternative polishing fluid delivery system.

FIG. 3 is a sectional schematic view of an alternative polishing fluid delivery system 300. The system 300 is encompassed and supported by a drawer 310. Integrated unit 301 provides both a CLC controller and flow meter converter. Fluid from a fluid preparation manifold (not shown) enters the system 300 through an inlet 302. Fluid then flows directly into an ultrasonic flow meter 303. From the flow meter 303, the fluid flows through tubing 304, then a proportional valve and stepper motor 305. Tubing 306 connects the proportional valve and stepper motor 305 and a shutoff valve 307. The fluid exits the system 300 to enter the slurry delivery arm through outlet 308. The two way valve 307 has a drain 309.

The nitrogen in the purge line of the slurry delivery arm and the nitrogen introduced in the fluid delivery manifold can encourage formation of small bubbles in the fluid delivery system. These bubbles are especially troublesome as the fluid flows through the ultrasonic flow meter. The embodiment depicted by FIG. 3 has improved slurry delivery characteristics over the embodiment depicted by FIG. 2 because the two way valve 307 provides proper pressure drop conditions for the slurry traveling on to the slurry delivery arm. The embodiment depicted by FIG. 2 may have pressure drop issues as the fluid is delivered to the slurry delivery arm. That is, the back pressure in the line to the slurry delivery arm may fill with bubbles, degrading the ability of the flow controller to provide a consistent volume of fluid because the integrity of the flow controller is compromised if it is filled with bubbles. Placing the shutoff valve between the flow controller and slurry delivery arm solves the pressure drop problem. Alternatively, a check valve, degasser, or other reverse flow restrictor to prevent backwards flow in the same location may solve the bubble formation problem.

The embodiment depicted by FIG. 3 also features a space saving design. The one piece integrated unit 301 that provides both a CLC controller and flow meter converter saves space over the two piece assembly of FIG. 2. The embodiments depicted by FIGS. 2 and 3 may have fluid flow of about 15 mL/min to about 1.5 L/min at a pressure greater than about 7 psi, preferably greater than about 15 psi.

While the foregoing is directed to embodiments of the present invention, other and further embodiments of the invention may be devised without departing from the basic scope thereof, and the scope thereof is determined by the claims that follow.

The invention claimed is:

1. An apparatus for the delivery of slurry solution, comprising:

an ultrasonic flow meter that is connected to an inlet for slurry solution from a fluid preparation manifold and is positioned between the fluid preparation manifold and a slurry delivery arm;

a proportional valve that is connected to the ultrasonic flow meter; and a shutoff valve positioned between and connected to the proportional valve and the slurry delivery arm.

2. The apparatus of claim 1, wherein the ultrasonic flow meter, shutoff valve, and proportional valve are encompassed by a drawer of the apparatus, and the drawer further comprises a controller and flow meter converter.

3. The apparatus of claim 2, wherein the controller and flow meter converter are housed in one assembly in the drawer.

4. The apparatus of claim 1, further comprising a drawer that encompasses the ultrasonic flowmeter, the proportional valve, and the shutoff valve.

5. The apparatus of claim 1, wherein an inlet to the ultrasonic flow meter is configured for flow of greater than 15 psi.

6. The apparatus of claim 1, wherein the proportional valve is positioned between the flow meter and the shutoff valve.

7. The apparatus of claim 6, further comprising a stepper motor connected to the proportional valve.

8. The apparatus of claim 1, wherein an inlet to the ultrasonic flow meter is configured for a flow of about 15 mL/min to about 1.5 L/min.

9. An apparatus for the delivery of slurry solution, comprising:

an ultrasonic flow meter positioned to receive slurry solution from an inlet for fluid from a fluid preparation manifold;

a proportional valve and stepper motor in communication with and connected to the ultrasonic flow meter, wherein the proportional valve and the stepper motor are connected; and a reverse flow restrictor in communication with and connected to the proportional valve and a slurry delivery arm, wherein the reverse flow restrictor is between the proportional valve and the slurry delivery arm.

10. The apparatus of claim 9, wherein the reverse flow restrictor is a degasser, two way valve, or check valve.

11. The apparatus of claim 9, wherein the ultrasonic flow meter, shutoff valve, and proportional valve are encompassed by a drawer of the apparatus, and the drawer further comprises a controller and flow meter converter.

12. The apparatus of claim 11, wherein the controller and flow meter converter are housed in one assembly in the drawer.

13. The apparatus of claim 9, further comprising a drawer that encompasses the ultrasonic flowmeter, proportional valve and stepper motor, and reverse flow restrictor.

14. The apparatus of claim 9, wherein an inlet to the ultrasonic flow meter is configured for flow of greater than 15 psi.

15. The apparatus of claim 9, wherein the proportional valve is positioned between the ultrasonic flow meter and the reverse flow restrictor.

16. The apparatus of claim 15, wherein an inlet to the ultrasonic flow meter is configured for a flow of about 15 mL/min to about 1.5 L/min.

17. An apparatus for the delivery of slurry solution, comprising:

an inlet for slurry solution from a fluid preparation manifold;

an ultrasonic flow meter that is connected to the inlet and is adapted to receive slurry solution from the inlet;

a proportional valve that is connected to the ultrasonic flow meter to receive slurry solution from the ultrasonic flow meter; and a reverse flow restrictor that is connected to the proportional valve to receive slurry solution from the proportional valve and that is connected to an outlet for delivery of slurry solution to a slurry delivery arm.

18. The apparatus of claim 17, wherein the reverse flow restrictor is a degasser, two way valve, check valve, or shutoff valve.

19. The apparatus of claim 17, wherein the ultrasonic flow meter, reverse flow restrictor, and proportional valve are encompassed by a drawer of the apparatus, and the drawer further comprises a controller and flow meter converter.

20. The apparatus of claim 19, wherein the controller and flow meter converter are housed in one assembly in the drawer.

* * * * *